US008474576B2

(12) United States Patent
Renish

(10) Patent No.: US 8,474,576 B2
(45) Date of Patent: Jul. 2, 2013

(54) SCAFFOLD STORAGE PLANK

(76) Inventor: Lance Renish, Salina, KS (US)

( * ) Notice: Subject to any disclaimer, the term of this patent is extended or adjusted under 35 U.S.C. 154(b) by 0 days.

(21) Appl. No.: 13/078,709

(22) Filed: Apr. 1, 2011

(65) Prior Publication Data

US 2012/0043161 A1 Feb. 23, 2012

Related U.S. Application Data

(63) Continuation-in-part of application No. 12/861,667, filed on Aug. 23, 2010.

(51) Int. Cl.
*E04G 7/00* (2006.01)

(52) U.S. Cl.
USPC ..... 182/129; 206/372

(58) Field of Classification Search
USPC .... 182/129; 206/372, 373; 220/326; 248/238
See application file for complete search history.

(56) References Cited

U.S. PATENT DOCUMENTS

| | | | | | |
|---|---|---|---|---|---|
| 4,211,455 | A * | 7/1980 | Tedrow | 312/198 |
| 5,152,368 | A * | 10/1992 | Heiden | 182/118 |
| 5,464,115 | A * | 11/1995 | Tisbo et al. | 220/324 |
| 5,547,080 | A | 8/1996 | Klimas | |
| 5,873,463 | A * | 2/1999 | Purcell | 206/372 |
| 5,913,380 | A * | 6/1999 | Gugel et al. | 182/129 |
| 5,971,102 | A | 10/1999 | Brown | |
| 6,666,342 | B1 | 12/2003 | House | |
| 7,032,711 | B1 * | 4/2006 | Katz et al. | 182/129 |
| 8,096,152 | B2 * | 1/2012 | Wagh et al. | 70/56 |
| 2003/0233856 | A1 * | 12/2003 | Webb et al. | 70/69 |
| 2005/0133393 | A1 * | 6/2005 | Lawrence et al. | 206/349 |
| 2006/0021985 | A1 * | 2/2006 | Jasper | 220/475 |
| 2007/0187184 | A1 * | 8/2007 | Nasuti et al. | 187/269 |
| 2008/0110893 | A1 * | 5/2008 | Cowie et al. | 220/324 |
| 2008/0169322 | A1 * | 7/2008 | McMillan | 224/328 |

OTHER PUBLICATIONS

Definition of 'onto' found in Action The American Heritage® Dictionary of the English Language, Fourth Edition copyright © 2000 by Houghton Mifflin Company. Updated in 2009. Published by Houghton Mifflin Company. All rights reserved.*

* cited by examiner

*Primary Examiner* — Katherine Mitchell
*Assistant Examiner* — Daniel Cahn
(74) *Attorney, Agent, or Firm* — Crowell Law

(57) ABSTRACT

The present invention comprises a scaffolding system with scaffolding frames and at least one scaffold storage plank. The scaffold storage plank comprises of a body that contains a storage reservoir capable of holding tools or equipment. The scaffold storage plank further comprises a folding sectional cover to the storage reservoir and allows assess to the storage reservoir when the cover is in its open position. When the cover is in its closed position the scaffold storage plank functions as a means of support. The scaffold storage plank may be locked to the scaffolding structure in the closed position so that tools and equipment stored within the scaffolding system are secure.

4 Claims, 4 Drawing Sheets

SCAFFOLD STORAGE PLANK

CROSS REFERENCE TO RELATED U.S. APPLICATION DATA

This application is a continuation in part in accordance to 37 CFR 1.53(b) and contains disclosure from and claims the benefit under 35 U.S.C. 120 and/or 365(c).) of application Ser. No. 12/861,667 filed on Aug. 23, 2010.

FIELD OF INVENTION

This invention relates generally to scaffolding structures, and more particularly to an improved scaffold storage plank that provides a storage reservoir and a security locking device.

BACKGROUND OF THE INVENTION

Conventionally, scaffolds, or a system of scaffolds, are made of a frame of metal tubes, bars or other beam members to form a lattice on which a plurality of scaffold planks rest. A common frame is made, for example, of one and one-half inch outer diameter tubes. The frame provides the vertical support for the planks, and the planks provide the platform upon which the workers, such as painters, masons, and carpenters, can perform their labor without worrying about continually moving ladders. The majority of the scaffold planks of the prior art are made of wood, metal, or plastic and are utilized exclusively for support purposes. What is lacking from the prior art is a scaffold plank that can be utilized both as a platform and as a means for storage.

Traditionally, workers on a scaffolding system would also have to bring with them a toolbox that holds the necessary tools for the job at hand. These toolboxes are often cumbersome and even dangerous because the workers can either trip over them or knock them over the plank. Prior art U.S. Pat. No. 6,666,342 by House attempts to address the issue of tool storage by providing a tray system that attaches to the scaffolding frames. Although this is a better alternative than a traditional tool box, it fails to provide a more permanent and safe storage alternative for expensive tools that can be lost or stolen during off hours. Additionally, the method of tool storage taught in House would not protect the tools from the elements and would require workers to remove the tools from the scaffolding structure at the end of each work day or during extended work breaks.

U.S. Pat. No. 5,547,080 by Klimas teaches of a toolbox that directly suspends on a horizontal member of the scaffolding frame. Klamas's toolbox only utilizes a two hook system to suspend on the frame of the scaffold without any other means of security. Once again, workers would have to remove this toolbox and their tools from the scaffolding structure to prevent theft during off hours.

Prior art U.S. Pat. No. 5,971,102 by Brown teaches of a ladder system where the individual steps each comprises of a tool box system to store a variety of tools. However, Brown fails to implement its invention toward a scaffolding system and scaffold planks Brown's invention fails to address the need to secure the tools during off hours when theft of the stored tools become a concern.

Therefore, a need exists for a scaffold storage plank to function as both a support platform and as tool storage capable of being securely fixed and locked onto a scaffolding frame so that workers can easily access their tools while on the scaffolding system and safely store their tools on the scaffolding system without worrying about theft. These and other objects and advantages of the present invention will be more readily apparent from a consideration of the following drawings and a detailed description of the preferred embodiment.

SUMMARY

It is therefore an object of the present invention to overcome the aforementioned disadvantages of prior art devices and provide a relatively inexpensive scaffold plank that provides the versatility of being a support structure and a storage structure. The scaffold storage plank of the present invention allows easy access to desired tools when workers are working on top of the scaffolding structure. When the work day is finished or during extended work breaks, workers can store all their tools and supplies within the storage reservoir, close the folding sectional cover and lock the storage plank onto the frame of the scaffolding structure.

These and other objects of the present invention are achieved and disclosed in the preferred embodiment where the novel scaffold storage plank comprises of a plank body with a storage reservoir and a folding sectional cover capable of covering the storage reservoir. In the preferred embodiment the folding sectional cover is pivotally connected to the inside of the storage reservoir. A locking mechanism is used to secure the scaffold plank and the said folding sectional cover in the closed position onto a scaffolding frame.

These and other novel features and advantages of the invention will be described in greater detail in the following detailed description.

BRIEF DESCRIPTION OF THE DRAWINGS

The above description and other objects, advantages, and features of the present embodiment will be more fully understood and appreciated by reference to the specification and accompanying drawings, wherein.

DETAILED DISCUSSION OF THE PREFERRED EMBODIMENTS

Figure 1:
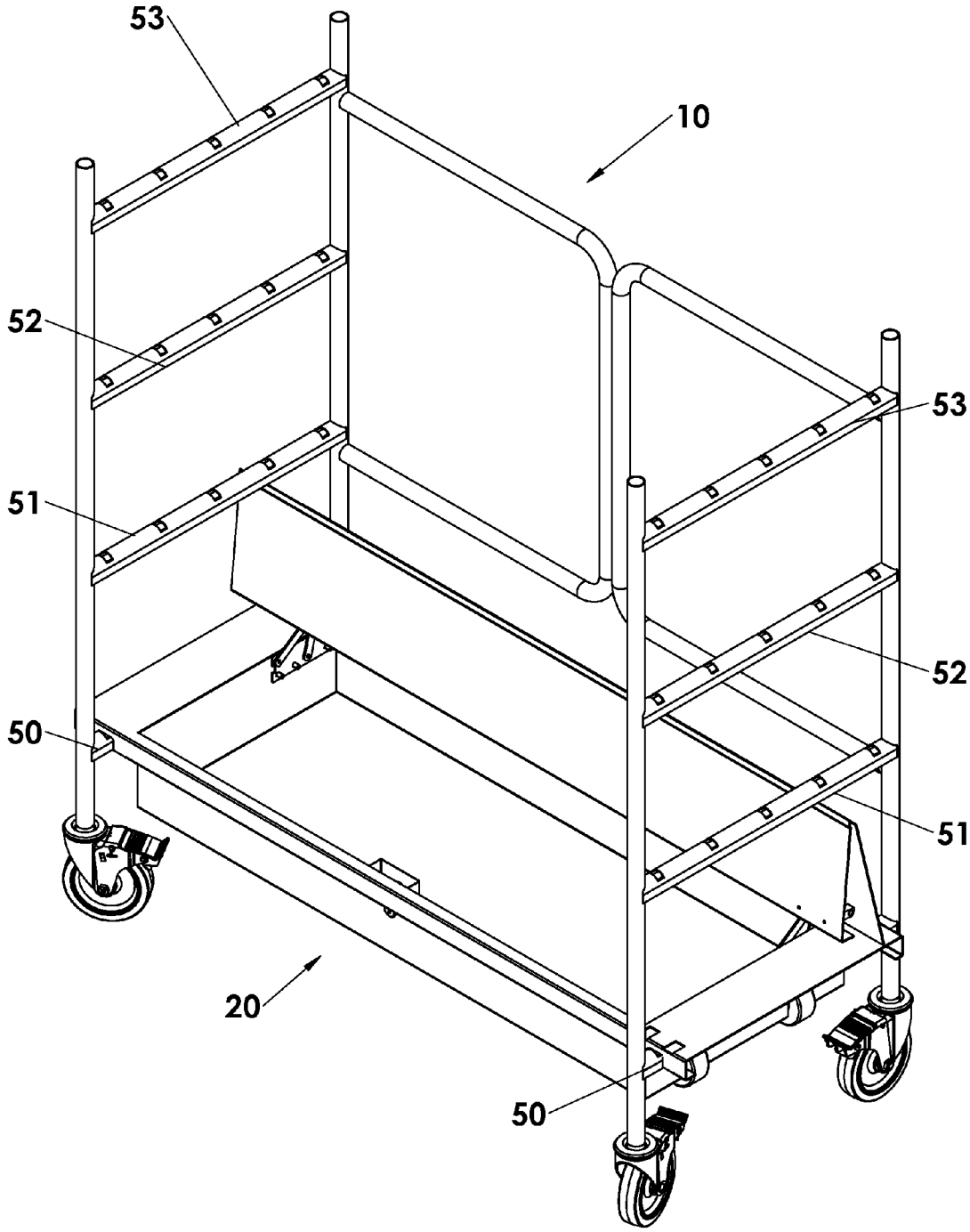
FIG. 1 is a perspective view of the scaffolding system with the scaffold storage plank positioned on a portable scaffolding structure.

Referring to FIG. 1, a portable and adjustable scaffolding system with a storage scaffold plank is generally depicted as element 10. The scaffolding system 10 may support multiple planks In the preferred embodiment, the storage plank 20 contains a storage reservoir 24. The elevation of the storage plank 20 is adjustable and may be positioned in conjunction with scaffolding frames 50, 51, 52 and 53.

Figure 2:
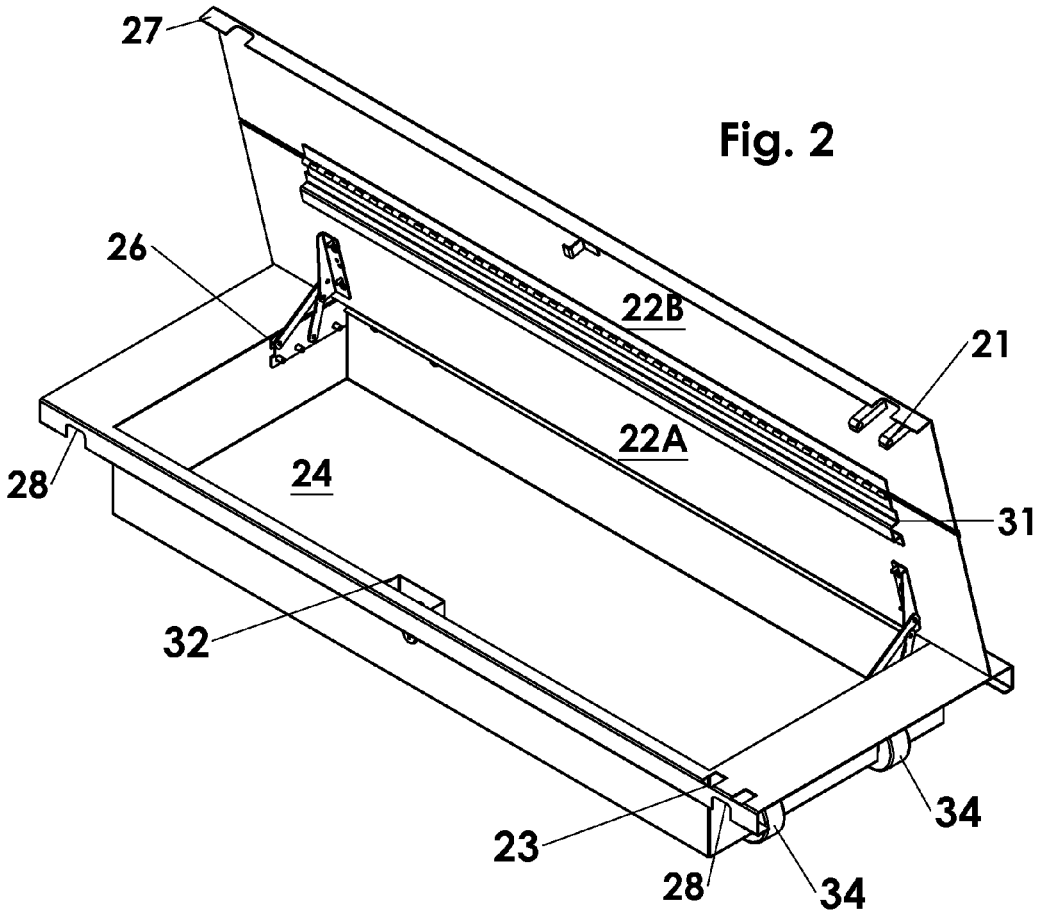
FIG. 2 is a perspective view of the scaffold storage plank with the folding sectional cover in the extended open position.
Figure 6:
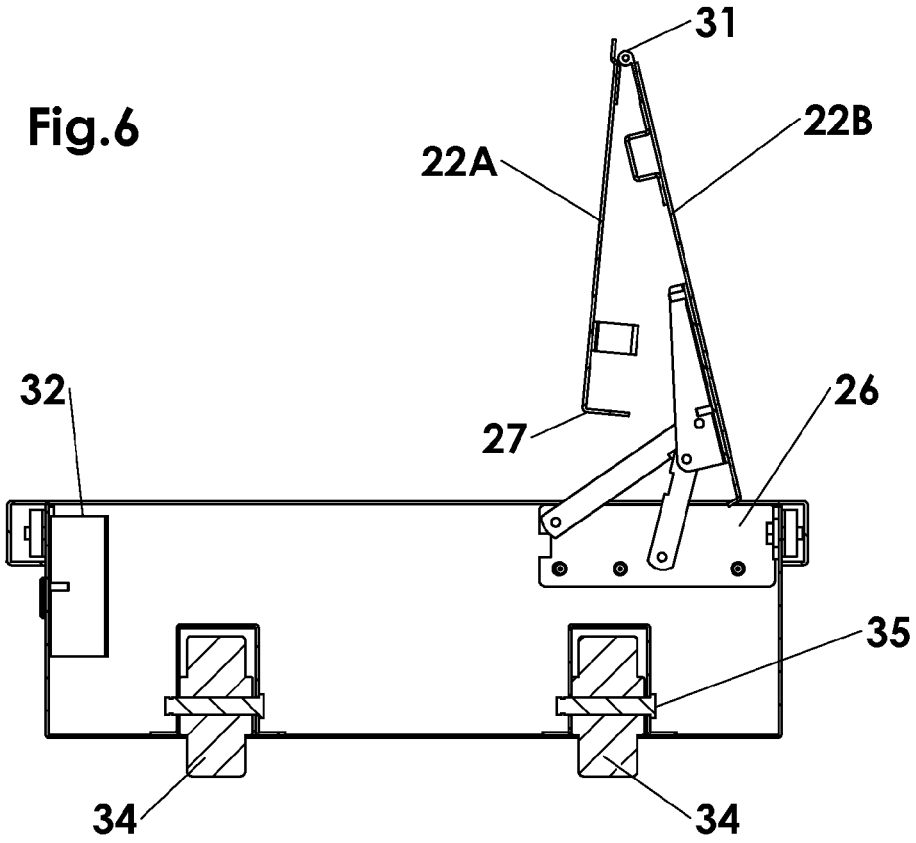
FIG. 6 is a right side sectional view of the scaffold storage plank with the folding sectional cover in the open and folded position.
Figure 7:
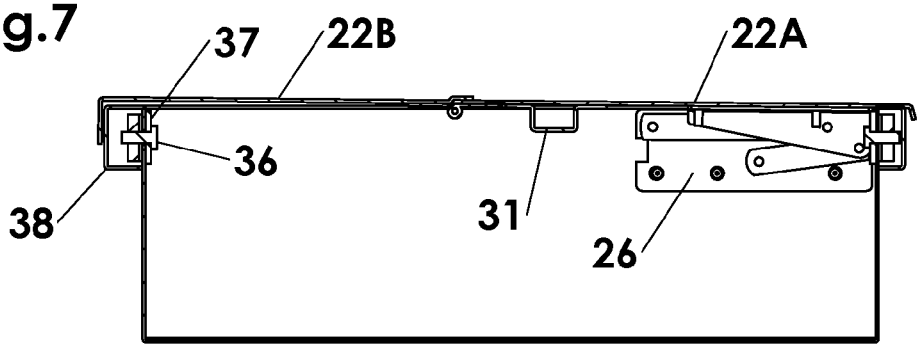
FIG. 7 is a left side sectional view of the scaffold storage plank with the folding sectional cover in the closed position.

FIG. 2 shows the storage plank 20 comprised of a folding sectional cover with section 22*a* and section 22*b* for covering the body of the storage plank 25 and storage reservoir 24. The storage plank body 25 comprise of multiple notches 28 on both sides of the body used to set and secure the storage plank 20 onto a scaffolding frame. In the preferred embodiment, the sections 22*a* and 22*b* are connected together using a piano hinge 31. The piano hinge 31 is secured to the bottom of the sections 22*a* and 22*b* in accordance to FIG. 2. The folding sectional cover allows cover section 22*a* to fold inward onto section 22*b* in the open position, in accordance to FIG. 6, which is essential when the clearance between scaffolding frames 50-53 are limited and alternative covers would not be able to fully extend outwards.

Figure 3:
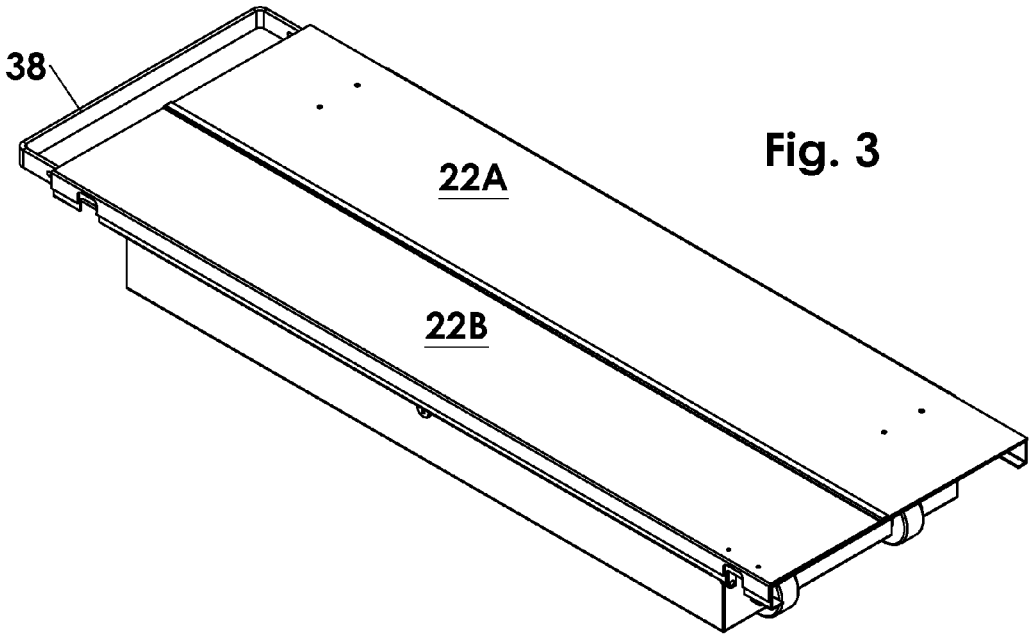
FIG. 3 is a perspective view of the scaffold storage plank with the folding sectional cover in the closed position.
Figure 4:
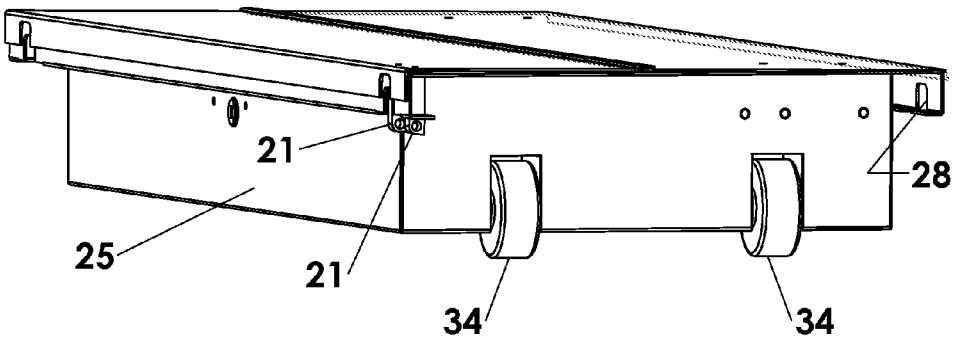
FIG. 4 is another perspective view of the scaffold storage plank with the folding sectional cover closed.
Figure 5:
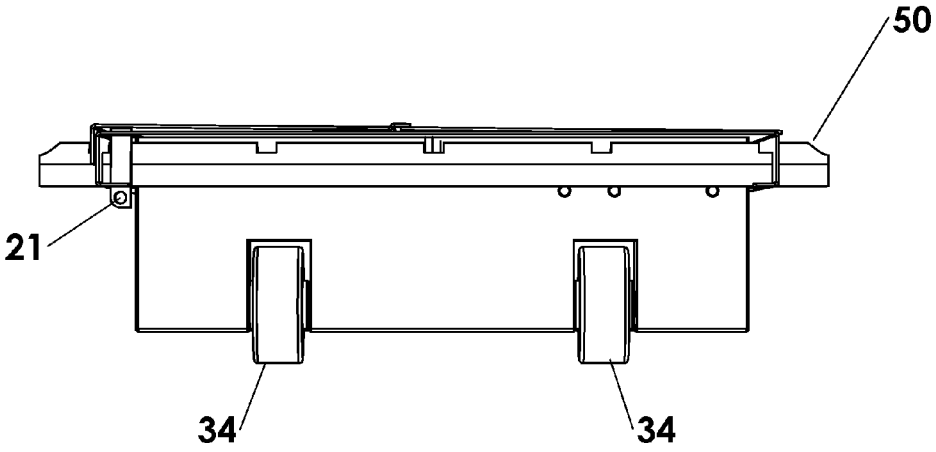
FIG. 5 is a side view of the scaffold storage plank with the folding sectional cover closed.

The folding sectional cover section 22*a* is pivotally connected to the plank body 25 by multiple locking spring hinges 26. The locking spring hinges 26 allow the folding sectional cover to stay in the open position even in an elevated environment where the wind may be particularly strong. This allows workers to add and remove tools without the risk of the folding sectional cover accidentally closing on the hands of the worker. The locking spring hinge 26 also prevents the folding sectional cover from accidentally opening while in the closed position due to wind or vibration. FIG. 3 shows the storage plank 20 with the folding sectional cover in the closed position. When closed, the storage plank 20 functions as intended, as a work bench or support structure for the workers.

A key novelty of the present invention is the ability to lock the entire storage plank 20 with the folding sectional cover closed and secured to the scaffolding fixture 10 to prevent theft. Therefore, in the preferred embodiment, attached to the bottom side of the section 22*b* of the folding sectional cover are two latch bars 21. On the body of the plank are two latch holes 23 positioned on both side of the notch 28 and sized to allow the latch bars 21 to fit through the body of plank when the folding sectional cover is in its closed position. At the tip of each latch bar 21 is a locking hole that allows a lock or chain to connect the two latch bars 21. This combination of latch bars 21 and latch holes positioned around the notch 28 allows users to secure the scaffolding frame 50 between the notch 28 and latch bars 21 when the folding sectional cover is in the closed position, thus locking the entire storage plank 20 onto the scaffolding frame 50. Furthermore, the locking spring hinges 26 are secured on the inside of the storage reservoir 24 and the bottom side of the section 22*a* of the folding sectional cover so that in the closed and locked position, the hinges 26 act as another means of preventing the cover from being opened by unauthorized individuals.

FIG. 3 shows the storage plank 20 in its closed position and illustrates the positioning of the latch bars 21 around the scaffolding frame. Although in the preferred embodiment, only one side comprises of the latching bars 21, it is understood that the latching bars 21 can be positioned on either or both sides of the plank and can be used to lock the plank to multiple locations on the scaffolding frame.

In addition to means of locking the entire storage plank to the scaffolding frame, the preferred embodiment includes a cam lack 32 that provides a means of locking the folding sectional cover in the closed position when the storage plank 20 is detached from the scaffolding frame. To facilitate the transportation of the storage plank 20 independently of the scaffolding frame, optional wheels 34 may be installed to the body of the storage plank. A retractable handle 38 is slideably attached on the polar side of the latching bars. In the preferred embodiment, the wheels 34 are attached to the storage plank by shoulder bots 35. The slideably mounted handle 34 is secured by weld nuts 37 and can be positioned by slide pins 36.

In the preferred embodiment, section 22*b* of the folding sectional cover also comprises a flange guard 27 which in its closed position further protects the storage reservoir and provides additional security against theft. Furthermore, the storage reservoir 24 in the preferred embodiment may have ridges horizontally positioned to allow tiered storage where a tool tray can rest on top of the ridge. In the preferred embodiment, the storage plank 20 is constructed out of light weight steel or other suitable material.

Throughout the specification the aim has been to describe the invention without limiting the invention to any one embodiment or specific collection of features. Persons skilled in the relevant art may realize variations from the specific embodiment that will nonetheless fall within the scope of the invention. For example, a scaffolding system can comprise of more than one storage planks 20. The scaffolding system can be of any type or size known in the art and need not be portable.

The size of the scaffold plank and the volume of the storage reservoir are not limited to any specific dimensions. The utility of the storage reservoir goes beyond just tools and can be used, depending on its size, to store construction supplies such as aluminum piping, bricks, etc.

The means of locking the storage plank 20 to the scaffolding fixture is not limited to the latch bars 21. For example, instead of latch bars 21, the folding sectional cover may contain latch holes in parallel to the latch holes of the body, thus allowing a pad lock to secure the storage plank to the scaffolding frame in its closed position, not depicted.

The means of opening the folding sectional cover is not limited to the locking spring hinge 26. Alternative hinges or means of opening the cover to expose the storage reservoir 24 are within the scope of the present invention. Furthermore, the location of the hinges can be positioned anywhere within the storage reservoir 24, thus dictating the direction and manner in which folding sectional cover may be opened. Neither is there a limitation to the folding sectional cover being fixed in any manner to the storage reservoir 24 as it may be completely removable for access to the storage reservoir 24. The size of the folding sectional cover is not limited to the size of the body section; instead the folding sectional cover only needs to allow access to the storage reservoir 24. The folding sectional cover may have more than two sections and may fold both inward and outward. The storage plank 20 can be constructed of any material known in the art including metal, wood, and synthetic material.

Accordingly, the scope of the invention should be determined not by the embodiment illustrated, but by the appended claims and their legal equivalents.

I claim:

1. A scaffold storage plank comprising:

a plank body suitable for supporting a person, the plank body further comprising a storage reservoir; and a cover capable of covering said storage reservoir;

wherein the said cover comprises a folding sectional cover of at least two sections, wherein:

a) a first section of the at least two sections is pivotally connected to an inside of the said storage reservoir; and b) a second section of the at least two sections is hingedly connected to said first section via a piano hinge;

wherein the said folding sectional cover is pivotally connected internally to said storage reservoir using a locking spring hinge that can pivot the cover between an open position and a closed position so that the open position allows a user access to the reservoir and the closed position covers a top opening of said reservoir to deny access to said reservoir, where said folding sectional cover further comprises at least two latching bars, wherein:

a) one end of each of said latching bars respectively is secured to a bottom side of said folding section cover and another end of each of said latching bars respectively comprises of a locking hole; and b) each of said latching bars respectively are long enough to extend beyond, and on either side of, a scaffolding frame; wherein said locking holes are capable of receiving a pad lock in order to said storage plank to said scaffolding frame;

said plank body further comprises at least one notch sized to fit said scaffolding frame within and comprises a set of latch holes positioned on both sides of said notch, said latch holes capable of receiving said latch bars when the said cover is in the closed position.

2. The scaffold storage plank of claim 1 wherein said cover further comprises of a flange guard angled substantially perpendicular to said second section of said cover thus overlapping an outer wall of said plank body when said cover is in the closed position.

3. The scaffold storage plank of claim 1 wherein the said body further comprises at least one wheel and a handle.

4. The scaffolding storage plank of claim 3 wherein said handle is retractable and located on a side of said plank body opposite to a location of said at least one wheel.

* * * * *